United States Patent [19]

Meier

[11] 3,971,732

[45] July 27, 1976

[54] APPARATUS FOR FIXING RADIOACTIVE WASTE

[75] Inventor: Gerhard Meier, Karlsruhe, Germany

[73] Assignees: Gesellschaft fur Kernforschung m.b.H., Karlsruhe; Firma Werner & Pfleiderer, Stuttgart, both of Germany

[22] Filed: Dec. 5, 1974

[21] Appl. No.: 530,144

[30] Foreign Application Priority Data

Dec. 12, 1973 Germany ..... 2361732

[52] U.S. Cl. ..... 252/301.15; 252/301.1 W; 259/157

[51] Int. Cl.[2] ..... G21F 9/16

[58] Field of Search ..... 252/301.15, 301.1 W; 259/155, 156, 157, 159 R

[56] References Cited

UNITED STATES PATENTS

| | | | |
|---|---|---|---|
| 3,298,961 | 1/1967 | Davis et al. | 252/301.1 W |
| 3,463,738 | 8/1969 | Fitzgerald et al. | 252/301.1 W |

FOREIGN PATENTS OR APPLICATIONS

| | | | |
|---|---|---|---|
| 754,476 | 3/1967 | Canada | 252/301.1 W |
| 1,086,719 | 10/1967 | United Kingdom | 252/301.1 W |

*Primary Examiner*—Benjamin R. Padgett
*Assistant Examiner*—Deborah L. Kyle
*Attorney, Agent, or Firm*—Spencer & Kaye

[57] ABSTRACT

An apparatus for fixing radioactive or toxic waste has an extruder including a mixing mechanism for intermingling and advancing the waste and a carrier material introduced into the extruder. The extruder has a heating zone with which there communicates a vapor outlet device having an observation window. Within the vapor outlet device there is disposed an arrangement for cleaning the window and an arrangement for removing deposits from those locations of the vapor outlet device that are adjacent the mixing mechanism. The condenser is coupled to a distillate accumulator with the interposition of two alternatingly operating filters for removing particles from the condensate obtained from the condenser. To the outlet of the extruder there is coupled a loading device in which containers are successively filled with the material discharged by the extruder. The loading device includes an interrupter bowl which receives the material discharged by the extruder during an exchange of an empty container for a filled container below the extruder outlet.

10 Claims, 3 Drawing Figures

APPARATUS FOR FIXING RADIOACTIVE WASTE

BACKGROUND OF THE INVENTION

This invention relates to an apparatus for fixing radioactive and/or toxic waste materials obtained, for example, from nuclear installations. The apparatus is particularly designed for embedding aqueous concentrates, sludges and resins in a plasticizeable carrier material, such as hot bitumen. The apparatus has an extruder, as well as devices for the preparation, storage and the continuous, separated charging of carrier material and waste material into the extruder for mixing the materials. The extruder usually has two parallel-spaced horizontal shafts each carrying a screw conveyor passing through heating zones. Each heating zone has a vapor outlet device (vapor exhaust coupling) and a condenser, and after the condensers there is connected a common distillate accumulator. Each exhaust coupling is, at its upper end oriented away from the screw conveyors, closed by a window. With the extruder there are associated storage and/or transporting containers positioned, for example, on a rotatable disc for advancing the containers between the discharge spout of the extruder and the work zone of a conveying mechanism.

The production of nuclear energy is expected to sharply increase in the years ahead and thus necessarily one has to expect a substantial increase in the quantities of radioactive waste. These wastes have to be prepared in such a manner that the threat to the environment by residual radioactivities is excluded. It is noted that the quantities of liquid radioactive waste in a nuclear energy station are substantially greater than the quantities of solid wastes. Thus, the coolant circuit of a reactor is continuously contaminated by fission products and activated corrosion products so that a continuous purification is necessary. In addition, there is obtained radioactive waste water from the storage of fuel elements in water-filled containers and during the decontamination of reactor components and building structures. Further sources of radioactive waste water are leakages, laboratories and sanitary installations. The total waste water quantity in boiling water reactors is between 30,000 and 50,000 $m^3$ a year and in case of pressure water reactors, between 15,000 and 20,000 $m^3$ a year.

For decontaminating radioactive waste water in nuclear power installations several processes are used. Waste water having a relatively constant composition and small activity concentrations is treated by filtering through alluvial filters or by chemical precipitation. Empirical data show that this process yields 15 to 20 tons of residuals yearly. This volume, however, is substantially increased by the addition of inactive materials, such as filtering agents and precipitation reactants.

The purification of salt-poor waste water obtained from the reactor circuits and fuel element storage containers is effected almost exclusively by means of ion exchangers. The yield of ion exchange resin wastes is, dependent upon the type of reactor, between 10 and 20 $m^3$ annually, with a specific activity in the order of magnitude of 10 to 500 $Ci/m^3$.

The most universal and most effective process for the decontamination of radioactive waste water is vaporization. It finds application where larger quantities of waste water may be found which have a high activity in ion form bound to solid material. This process makes possible to increase the salt concentration of radioactive raw water up to approximately 30%.

The purpose of conditioning radioactive concentrates from the waste water preparation is to convert the final product into a storable, that is, a water-insoluble form.

Besides a mixing with cement up to a salt content of approximately 10 to 15% per weight, as a fixing method the substantially more advantageous embedding of aqueous concentrates or sludges or resins in hot bitumen is used. Here the fixation may be up to 60% by weight salt so that a 200 liter barrel may receive approximately 168 kg salt as opposed to 20 kg salt per barrel when the cementing process is used.

According to a known bitumenization process, the sludges or concentrates are introduced into the bitumen at a temperature of more than 140°C by means of a dual-shaft extruder, whereby the water is evaporated and the radioactive salts are mixed with bitumen.

The above-outlined bituminization apparatus has a number of disadvantages which substantially increase the likelihood of malfunctioning and may require extensive maintenance work on heavily contaminated devices. Thus, for example, in the zone of the vapor exhaust device adjacent the screw conveyors of the extruder there are formed, during operation, deposits of radioactive salts which adversely affect the operation or even render it impossible because the resulting radiation limits the operational freedom of the maintenance or servicing personnel. The observation window at the upper end of the vapor exhaust device becomes obstructed after a relatively short period as a result of soiling by tar sprayers. The distillate produced in the condensers adjoining the vapor exhaust devices still carries bitumen particles which may adversely affect the operation of the evaporator unit. These particles must be removed in any event. from the distillate before its further processing to prevent organic material from entering the after-connected devices. Further, the loading of the mixture formed of bitumen and radioactive salts can be effected in the known apparatuses only by complex mechanisms which are thus prone to malfunctioning. In these known devices several containers are arranged on two rotary discs and to the discharge spout of the extruder there is attached a hose-like switchable device so that the mixed material emerging from the extruder can be, after filling one container on the first rotary disc, introduced without interruption into an empty container positioned on the second rotary disc.

SUMMARY OF THE INVENTION

It is an object of the invention to provide an improved apparatus for fixing radioactive and/or toxic wastes from which the above-discussed drawbacks are eliminated thus creating conditions for a disturbance-free operation for long periods without the necessity of external interference involving long inoperative periods and further, which insures superior operational safety.

This object and others to become apparent as the specification progresses, are accomplished by the invention, according to which, briefly stated, the apparatus for fixing radioactive or toxic waste has an extruder including a mixing mechanism for intermingling and advancing the waste and a carrier material introduced into the extruder. The extruder has a heating zone with which there communicates a vapor outlet device having an observation window. Within the vapor outlet device there is disposed an arrangement for cleaning the window and an arrangement for removing deposits from those locations of the vapor outlet device that are adjacent the mixing mechanism. The condenser is coupled to a distillate accumulator with the interposition of two alternatingly operating filters for removing particles from the condensate obtained from the condenser. To the outlet of the extruder there is coupled a loading device in which containers are successively filled with the material discharged by the extruder. The loading device includes an interrupter bowl which receives the material discharged by the extruder during an exchange of an empty container for a filled container below the extruder outlet.

The advantages accomplished by the invention reside particularly in that the utilization factor of an apparatus for fixing radioactive and/or toxic waste is significantly increased with the aid of simple means which effect a substantial reduction in the soiling of components with radioactive materials. Thus, the supplemental work necessary in conventional apparatus for removing such soiling material and the operational pauses involved, are substantially or entirely eliminated. By practicing the invention, the radioactive waste fixing apparatus associated, for example, with a nuclear installation of known waste yield may be of reduced capacity compared to conventional apparatus. In this manner, better efficiency is ensured, involving economy of space and capital investment. A further important advantage resides in the substantially reduced radiation exposure of personnel, due to significantly reduced periods of maintenance.

DESCRIPTION OF THE PREFERRED EMBODIMENT

Figure 1:
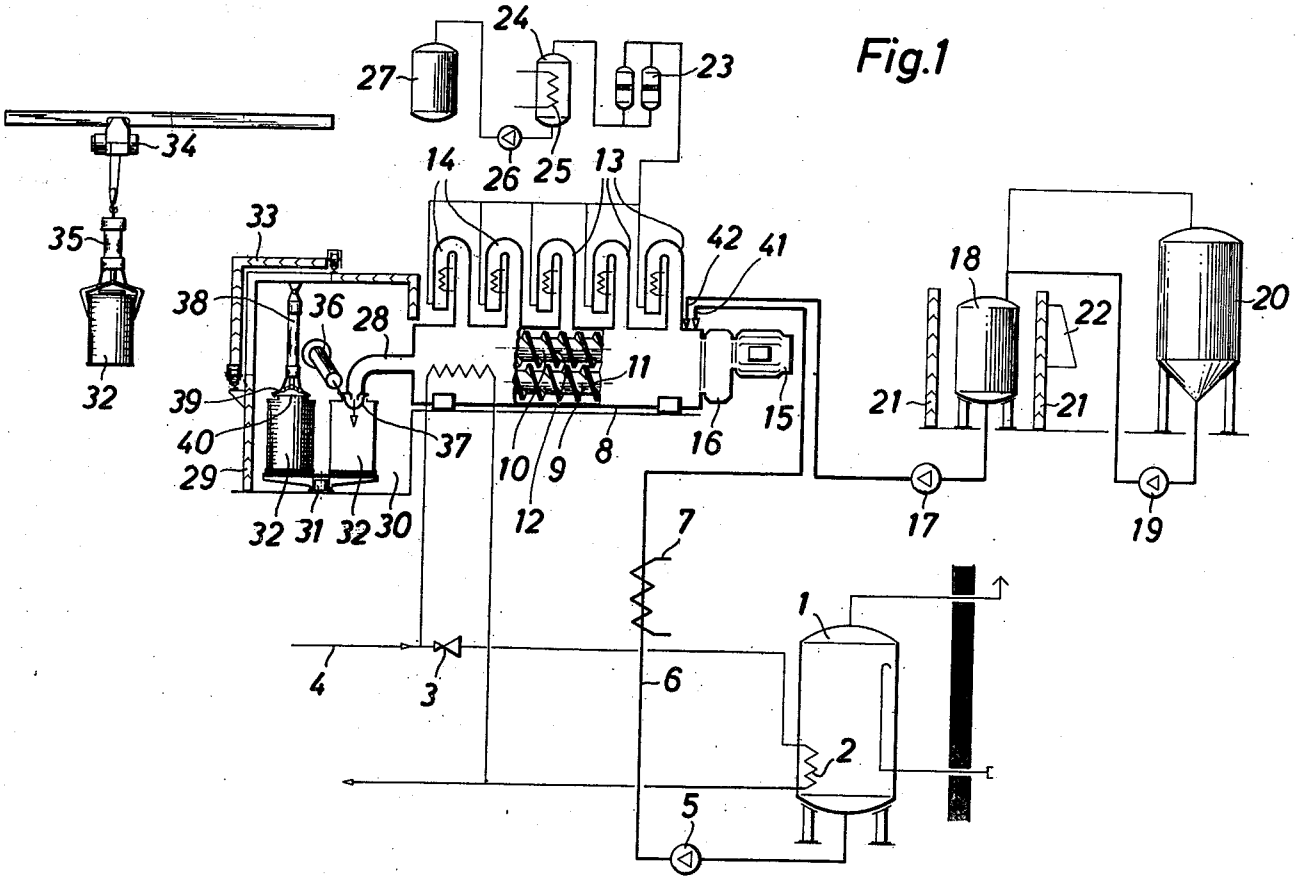
FIG. 1 is a schematic overall view of a bituminization system incorporating the invention.

A preferred embodiment of an apparatus for fixing radioactive and/or toxic waste may find application in a bituminization system illustrated schematically in FIG. 1. In a storage tank 1 having a volume of approximately 20 $m^3$, bitumen is heated to 140°C by means of a heat exchanger 2. The heat exchanger 2 is connected by means of a reducing valve 3 to a heating vapor conduit 4. The heating vapor is, in the conduit 4, brought from 16 atm. gauge and 203°C to 8 atm. gauge and 175°C by means of the reducing valve 3. A bitumen metering pump 5 supplies the liquid bitumen through a conduit 6 provided with a heater 7 to a dual-shaft extruder 8. In the mixing chamber of the extruder 8 there are disposed parallel-spaced shafts 9 and 10 on which there are arranged respective screw conveyors 11 and 12 of different length and pitch. The turns of the two screw conveyors are in an interleaving relationship with one another and rotate in the same direction, thereby mixing together the radioactive concentrate and the bitumen and at the same time, advancing the mixture in an axial direction. The screw conveyors are supported in 11 housing parts flanged to one another; the housing parts are combined into housing pairs, each defining a vapor-heated heating zone. Each heating zone is provided with a vapor outlet device constituted by a tubular vapor exhaust coupling 13 and a condenser 14. Each heating zone has a temperature-regulating device. The screw conveyors are rotated with a speed of up to 300 rpm by a 60 kW D.C. motor 15 with the intermediary of a drive gearing 16. A concentrate metering pump 17 feeds the extruder 8 with a concentrate consisting of liquid radioactive waste from a storage container 18 which, in turn, is charged by means of a further pump 19 from a larger storage vessel 20. The storage container 18 is shielded by lead walls 21 through which, while observing safety regulations, samples may be withdrawn into a specimen box 22. The vapor generated in the extruder 8 upon introduction of the concentrate into the bitumen, is precipitated in five condensers 14 and the distillate, for removing the bitumen particles still being carried, is passed through a tar filter 23 and introduced into a distillate accumulator 24 provided with a cooling device 25. A distillate pump 26 advances the distillate into an evaporator 27 for further purification.

In the zone of the outlet or discharge spout 28 of the extruder 8 there is provided a loading device, constituted by a charging cabin 30 provided with lead walls 29 forming a radiation shield. In the cabin 30 there is disposed a mechanically driven rotary disc 31 which is movable in either direction and on which there are disposed, for example six barrels 32 (only two shown). A portion of the lateral wall and the ceiling of the cabin 30 constitute a slideable angle door 33 which may be shifted to provide an opening through which the barrels 32 may be moved by means of an overhead hoist 34 and a barrel gripper 35. The charging cabin 30 is ventilated by means of a ventilating system isolated from the other spaces. The mixed material emerges from the discharge spout 28 of the extruder 8 in a continuous manner. As soon as the barrel 32 positioned under the discharge spout 28 is filled, an interrupter bowl 37 is brought under the spout 28 by means of an externally operable actuating lever 36 and, by rotating the disc 31, an empty barrel 32 is moved under the extrusion nipple 28 to begin the filling thereof subsequent to pivoting away the interrupter bowl 37. The interrupter bowl 37 which is made, for example, of pressed sheet metal, catches approximately 2 liters of material and is filled approximately after four or five barrel changes. After such filling, the interrupter bowl 37 is dropped into the barrel below, so that the surface of the barrel will not be contaminated and an elimination of the filled interrupter bowl can be effected in a simple manner. For this purpose, the diameter of the interrupter bowl 37 is smaller than that of the filler opening provided in each barrel 32. A closure locking device 38 places, with a gripper 39, a closure 40 on the filler opening of the barrel 32, presses the closure 40 into the opening and deforms the closure edge by the four jaws of the gripper 39, so that a crimped closure lock is obtained.

Figure 2:
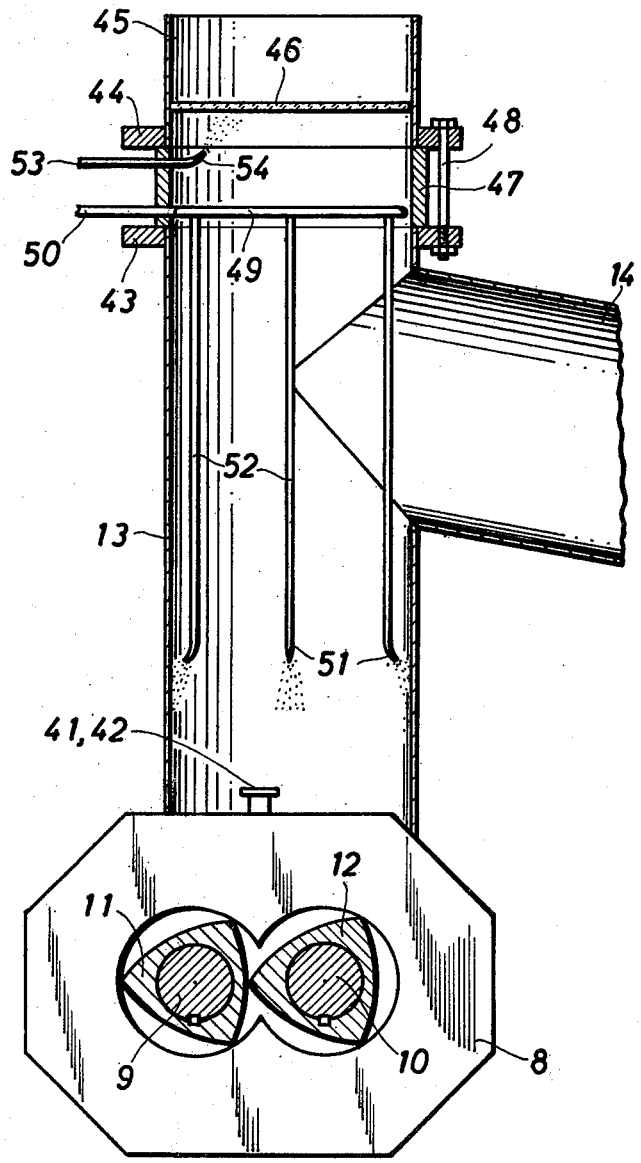
FIG. 2 is a schematic axial sectional view of a vapor outlet device according to a preferred embodiment of the invention.

Turning now to FIG. 2, there is illustrated a vapor exhaust coupling 13 of the dual-shaft extruder 8. To a flange 41 there is attached the conduit 6 for introducing the liquid bitumen, and to a flange 42 there is connected the concentrate conduit leading from the concentrate metering pump 17. By arranging the couplings for the bitumen conduit and the concentrate conduit above the shafts 9 and 10, a plug formation in the bitumen conduit is prevented. Between a flange 43 at the upper end of the vapor exhaust coupling 13 and a flange 44 of an adjoining tube 45 provided with a window 46, there is fixedly secured an intermediate ring 47 by means of tension screws 48. The ring 47 has the same internal diameter as the tubular coupling 13 and is contiguous therewith. Internally of the intermediate ring 47 there is arranged an annular tubular conduit (distributor) 49 which is connected to a steam supply conduit 50 passing through the ring 47 and supported thereby. From the underside of the distributor 49 there extend six tubes (vapor lances) 52 (only three shown) which have at their ends outlet nozzles 51 oriented towards the inner wall of the vapor exhaust coupling 13 at a distance of up to approximately 20 centimeters from the upper edge of the screw conveyors 11, 12. By means of the vapor lances 52 deposits of radioactive salts are removed from the inner wall of the exhaust coupling 13 in a simple manner whenever necessary, without interrupting the operation of the apparatus. The removed salt deposits are then mixed into the bitumen by the screw conveyors 11, 12. For cleaning the observation window 46, there is provided a further steam supply conduit 53 which passes through the intermediate ring 47 and is supported thereby. The steam conduit 53 has a nozzle terminal 54 projecting into the space defined by the ring 47. The nozzle 54 is directed towards the window 46, so that deposits which adversely affect the transparency of the glass may be removed in a simple manner. In case of a relatively large-area observation window 46, it is expedient to connect at the end of the steam conduit 53 a U-shaped or comb-shaped tube member, the free ends of which each carry a nozzle 54 oriented towards the observation window 46.

Figure 3:
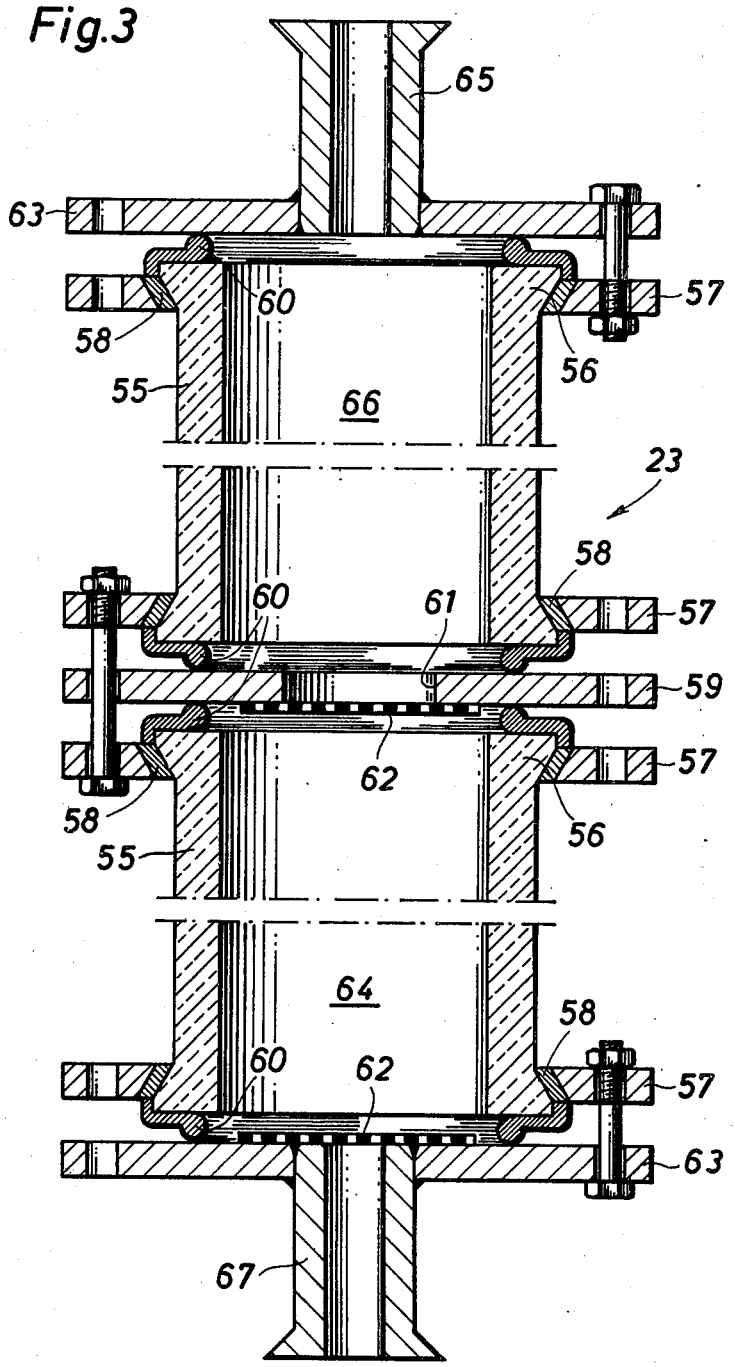
FIG. 3 is an axial sectional view of a tar filter according to a preferred embodiment of the invention.

FIG. 3 illustrates one of the vertically oriented tar filters 23. It comprises two transparent (glass) tubes 55 which have, at each of their end zones, a radially outwardly projecting conical collar 56 for attachment with a flange 57 with the interposition of a sealing ring 58. The glass tubes 55 are connected to one another by means of two flanges 57, an intermediate flange 59 and seals 60. Across the central bore 61 of the intermediate flange 59 there extends a first sieve 62. The lower end of the tar filter 23 is closed by a second sieve 62, a flange 57 with a sealing ring 58 and a flange 63 with a seal 60. The upper end of the tar filter 23 is closed in a similar manner, but has no sieve. The space 64 between the sieves 62 is filled with an oil-absorbing substance.

The distillate is introduced from the condenser 14 through the upper conduit coupling 65 into the filter 23. At the first sieve 62, the bitumen particles carried by the material are retained and they are collected in the space 66. After the separation of the oil contained in the distillate in the space 64, the purified distillate leaves the filter 23 through the conduit nipple 67 and is admitted — as it may be observed in FIG. 1 — to the distillate accumulator 24. Of the two identical filters 23 shown in FIG. 1, during operation one always constitutes the active (operating) filter, while the other is the reserve filter. The distillate stream is switched over from the active filter to the reserve filter when the space 66 of the operative filter 23 is filled with bitumen particles or, as the case may be, when the absorption capabilities of the oil-absorbing substance are exhausted or when the accumulated activity makes a replacement necessary. Each filter may be easily replaced with the aid of rapid couplings.

It will be understood that the above description of the present invention is susceptible to various modifications, changes and adaptations, and the same are intended to be comprehended within the meaning and range of equivalents of the appended claims.

I claim:

1. In an apparatus for fixing radioactive or toxic waste including an extruder having a mixing chamber; means for feeding the waste and a carrier material to the mixing chamber; means for mixing the waste and the carrier material in the mixing chamber and advancing the mixture therein; means defining a heating zone in said mixing chamber for heating the material therein; a vapor outlet device communicating with the heating zone; an observation window closing off an upper portion of the vapor outlet device remote from the mixing means; a condenser connected after the vapor outlet device; a distillate accumulator connected after the condenser; means defining an extruder outlet through which the mixture is discharged from the extruder; a loading device connected to the extruder outlet for successively charging containers with the mixture emerging from the extruder outlet; the improvement comprising a. first means disposed in said vapor outlet device for cleaning said observation window;

b. second means disposed in said vapor outlet device for removing deposits from a portion of said vapor outlet device that is adjacent said mixing means;

c. two alternatingly operating, vertically oriented filters connected between said condenser and said distillate accumulator for removing carrier particles from the condensate withdrawn from said condenser; each filter having means defining a filter inlet at an upper part of the filter and connected to said condenser; and means defining a filter outlet at a lower part of the filter and connected to said distillate accumulator and;

d. an interrupter bowl forming part of said loading device and being movably supported adjacent said extruder outlet for receiving the material from said extruder outlet during an exchange of an empty container for a filled container below said extruder outlet.

2. An apparatus as defined in claim 1, wherein said vapor outlet device has a generally tubular, vertically oriented wall; said second means comprising a. a steam conduit extending into said vapor outlet device;

b. an annular distributor conduit connected to said steam conduit and extending generally along the inside of said tubular wall;

c. a plurality of steam lances connected to and extending from said distributor conduit in the direction of said mixing means; and d. an outlet nozzle attached to each steam lance; each outlet nozzle being oriented towards said wall.

3. An apparatus as defined in claim 2, said first means comprising a. a steam conduit extending into said vapor outlet device; and b. an outlet nozzle attached to the steam conduit of said first means and oriented towards said observation window.

4. An apparatus as defined in claim 3, further comprising an intermediate ring inserted into said wall and being contiguous therewith; said ring supporting said steam conduits; said observation window being secured to said wall above said intermediate ring.

5. An apparatus as defined in claim 2, said first means comprising a. a steam conduit extending into said vapor outlet device;

b. a tube member having a plurality of free ends and connected to said steam conduit of said first means; and c. a nozzle attached to each end of said tube member, each nozzle of said first means being oriented towards said observation window.

6. An apparatus as defined in claim 5, wherein said tube member has a U-shape.

7. An apparatus as defined in claim 5, wherein said tube member is comb-shaped.

8. An apparatus as defined in claim 1, wherein each said filter comprises a tubular, transparent member filled with an oil-absorbing material.

9. An apparatus as defined in claim 8, further comprising two vertically spaced sieves disposed in each filter for defining a first volume portion thereof, said oil-absorbing material filling out said first volume portion; the upper sieve bounding a second volume portion extending above said first volume portion.

10. An apparatus as defined in claim 1, each said container having a charge opening; said interrupter bowl having a diameter that is smaller than the diameter of each charge opening, the volume of said interrupter bowl is sufficiently large to accommodate material from said extruder outlet during at least four container exchanges.

* * * * *